US007661404B2

(12) United States Patent
Lu

(10) Patent No.: US 7,661,404 B2
(45) Date of Patent: Feb. 16, 2010

(54) ANGLE-ADJUSTABLE ENGINE STARTING STRUCTURE FOR REMOTE-CONTROL TOY CAR

(76) Inventor: Ke-Way Lu, 3F, No. 165, An-Mei St., Taipei City (TW)

( * ) Notice: Subject to any disclaimer, the term of this patent is extended or adjusted under 35 U.S.C. 154(b) by 560 days.

(21) Appl. No.: 11/546,698

(22) Filed: Oct. 11, 2006

(65) Prior Publication Data

US 2008/0087118 A1 Apr. 17, 2008

(51) Int. Cl.
*F02N 11/00* (2006.01)
*F02N 15/06* (2006.01)

(52) U.S. Cl. ..... 123/179.25; 74/6

(58) Field of Classification Search ..... 123/179.1, 123/179.24, 179.25, 185.1, 185.2, 185.3, 123/185.6; 74/6, 7 C, 8; 185/39, 40 R, 41 A
See application file for complete search history.

(56) References Cited

U.S. PATENT DOCUMENTS 1,163,551 A * 12/1915 Marsh ..... 123/185.1
5,095,865 A * 3/1992 Keister ..... 123/179.5
6,532,908 B1 * 3/2003 Wang ..... 123/41 E
7,138,908 B2 * 11/2006 Lu ..... 340/426.13
7,343,891 B1 * 3/2008 Chang ..... 123/185.3
2004/0134293 A1 * 7/2004 Lai ..... 74/6
2006/0027201 A1 * 2/2006 Ono ..... 123/179.25
2006/0267345 A1 * 11/2006 Lu ..... 290/38 R

* cited by examiner

*Primary Examiner*—Stephen K Cronin
*Assistant Examiner*—Sizo B Vilakazi
(74) *Attorney, Agent, or Firm*—Ladas & Parry LLP

(57) ABSTRACT

An angle-adjustable engine starter structure for remote-control toy car is disclosed to include an engine, a driven gear coupled to an one-way axle bearing at the output shaft of the engine, a drive gear meshed with the driven gear and rotatable by an electric starter, a side cover covering the drive gear and the driven gear and having outside radial teeth, and an outer cover detachably fastened to the engine with screws and having radial teeth meshed with the radial teeth of the side cover to hold the side cover and the drive gear in position and for allowing adjustment of the angular position of the side cover and the drive gear relative to the driven gear after disconnection of the outer cover from the engine.

3 Claims, 9 Drawing Sheets

ANGLE-ADJUSTABLE ENGINE STARTING STRUCTURE FOR REMOTE-CONTROL TOY CAR

BACKGROUND OF THE INVENTION

1. Field of the Invention

The present invention relates an engine for remote-control toy car and more particularly, to an angle-adjustable engine starting structure for remote-control toy car, which allows adjustment of the starting angle subject to the condition of the environment.

2. Description of the Related Art

FIG. 1 shows a conventional engine for remote control toy car. This structure uses an electric starter instead of traction rope starting design. As illustrated, the output shaft of the engine is mounted with an one-way axle bearing 13, and then mounted with a partition board 2 and a driven gear 3. The driven gear 3 is meshed with a drive gear 41 inside a side cover 5 that is covered on the cylinder block of the engine. The drive gear 41 is affixed to a starter barrel 4, which is rotatably mounted in a through hole 51 of the side cover 5 and has two longitudinal crevices 42. An electric starter is used and coupled to the longitudinal crevices 42 of the starter barrel 4, and controlled to rotate the output shaft, thereby starting the engine.

According to the aforesaid design, the starter barrel is set at a fixed angle and not adjustable. In some places, the angle of the starter barrel does not allow operation of the electric starter to start the engine. In this case, the user must carry the remote-control toy car to a suitable place for starting. However, the remote-control toy car and the electric starter are heavy, not convenient to carry from place to place.

SUMMARY OF THE INVENTION

The present invention has been accomplished to provide an engine starting structure for remote-control toy car, which eliminates the aforesaid drawbacks. It is therefore the main object of the present invention to provide an angle-adjustable engine starting structure for remote-control toy car, which allows adjustment of the position of the starter barrel, enabling the user to start the engine conveniently at any place.

To achieve this and other objects and according to one aspect of the present invention, the angle-adjustable engine starting structure comprises an engine, a driven gear coupled to an one-way axle bearing at the output shaft of the engine, a drive gear meshed with the driven gear and rotatable by an electric starter, a side cover covering the drive gear and the driven gear and having outside radial teeth, and an outer cover detachably fastened to the engine with screws and having radial teeth meshed with the radial teeth of the side cover to hold the side cover and the drive gear in position and for allowing adjustment of the angular position of the side cover and the drive gear relative to the driven gear after disconnection of the outer cover from the engine.

According to another aspect of the present invention, the radial teeth of the outer cover and the radial teeth of the side cover have a 15° pitch angle.

According to still another aspect of the present invention, the outer cover has a 180° side opening, which receives the starter barrel and limits the adjustment angle of the side cover and the drive gear relative to the outer cover.

DETAILED DESCRIPTION OF THE INVENTION

Figure 1:
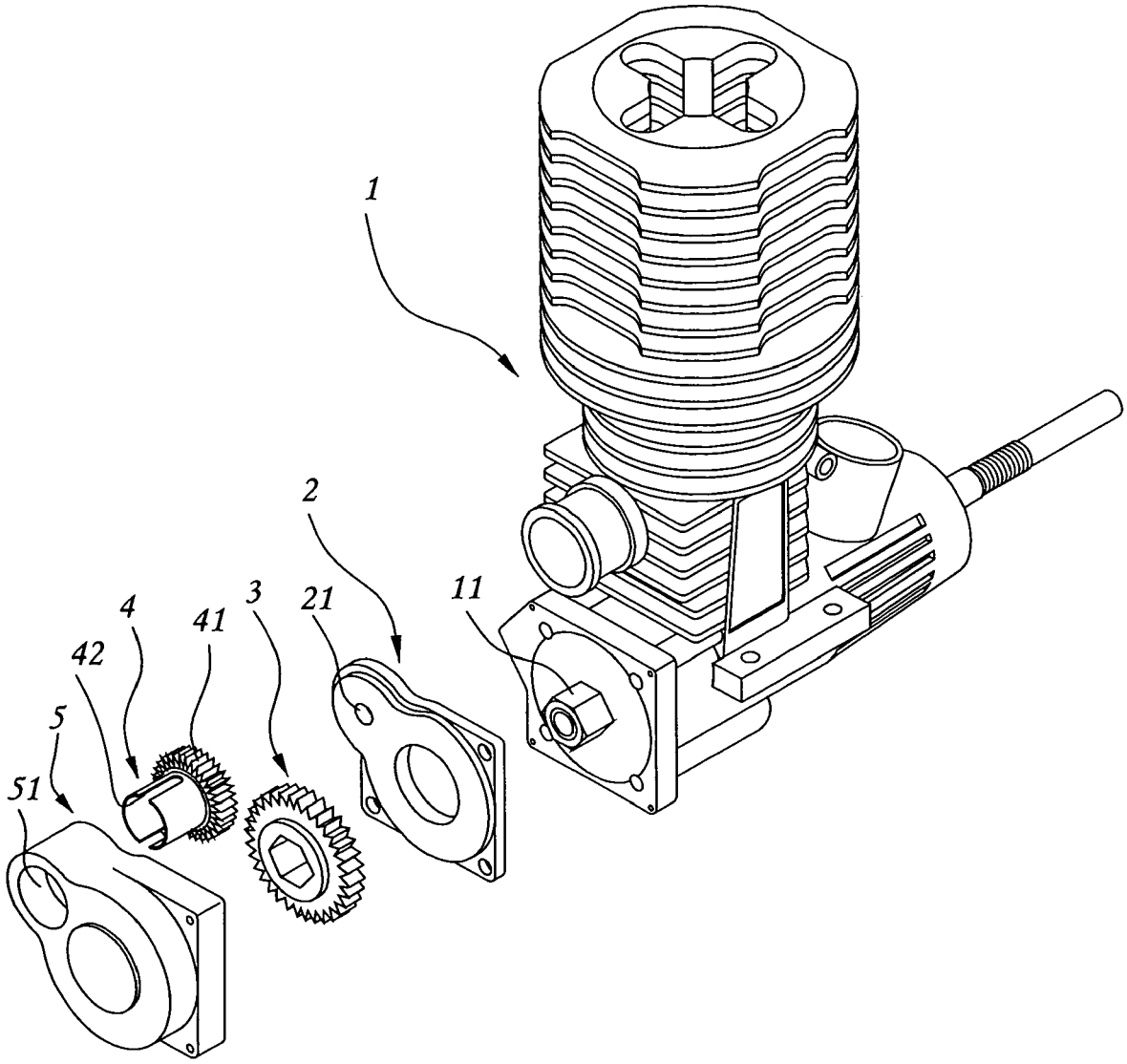
FIG. 1 is an elevational view of an engine starting structure for remote-control toy car according to the prior art.
Figure 2:
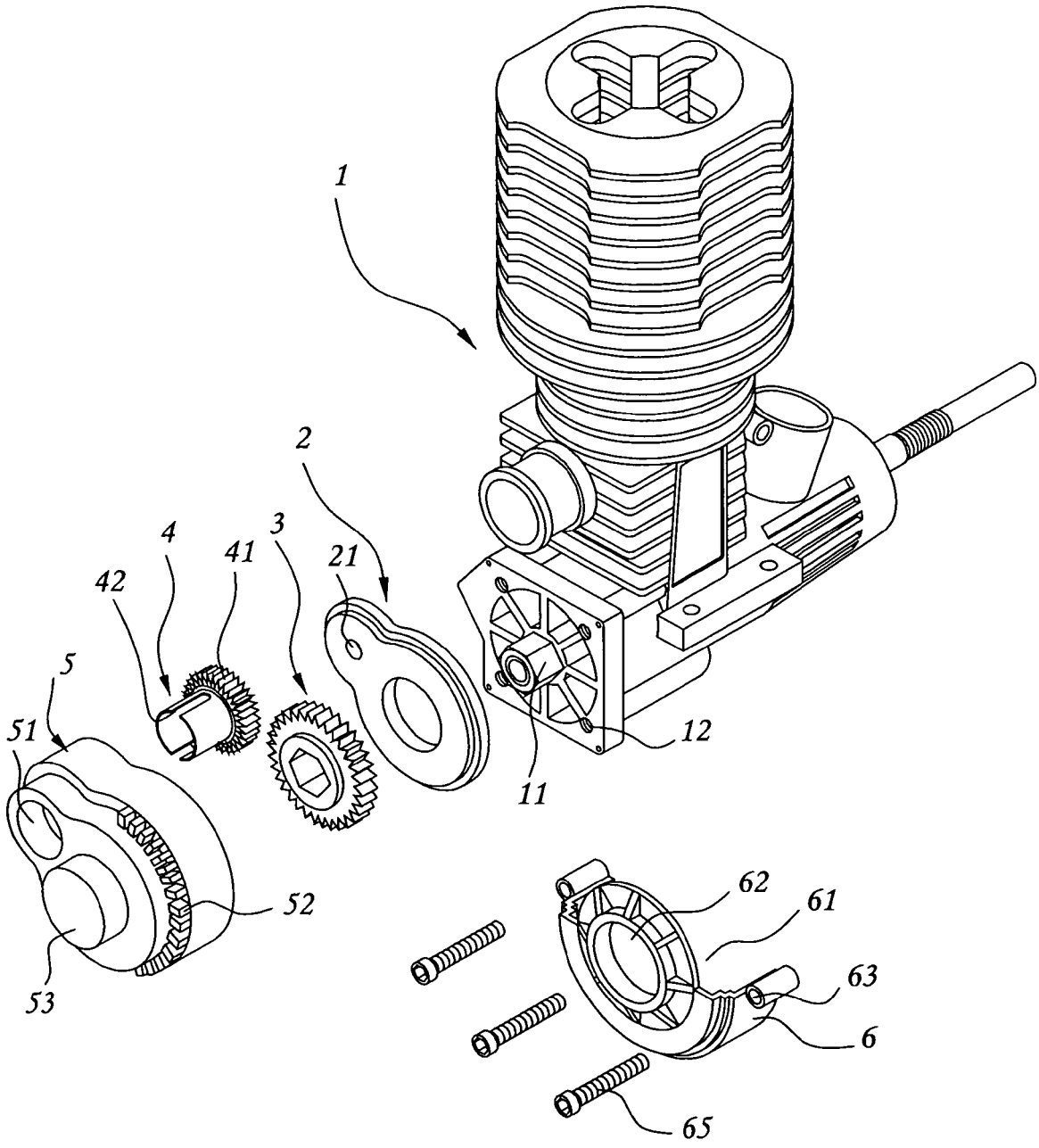
FIG. 2 is an exploded view of an angle-adjustable engine starting structure for remote-control toy car according to the present invention.
Figure 9:
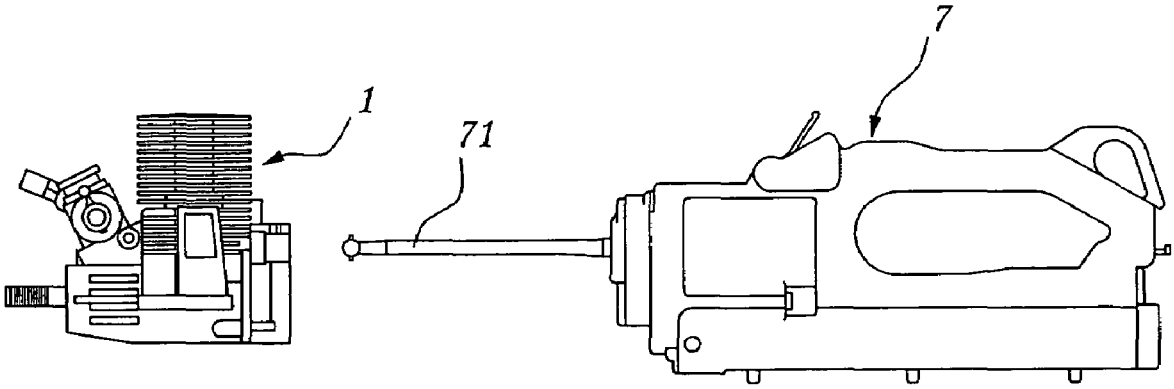
FIG. 9 is a schematic plain view showing the use of an electric starter with the angle-adjustable engine starting structure according to the present invention.

Referring to FIG. 2, the invention is comprised of an engine 1, a partition board 2, a driven gear 3, a starter barrel 4, a side cover 5, and an outer cover 6. The output shaft of the engine 1 is provided with an one-way axle bearing 11. The partition board 2 has an axle hole 21. The driven gear 3 has a polygonal center coupling hole coupled to the one-way axle bearing 11. The starter barrel 4 has a drive gear 41 fixedly provided at one end thereof and meshed with the driven gear 3, and two longitudinal crevices 42 symmetrically disposed at the other end for receiving the starter rod 71 of an electric starter 7 (see FIG. 9). The drive gear 41 has a shaft (not shown) coupled to an axle hole 21 on the partition board 2.

Figure 3:
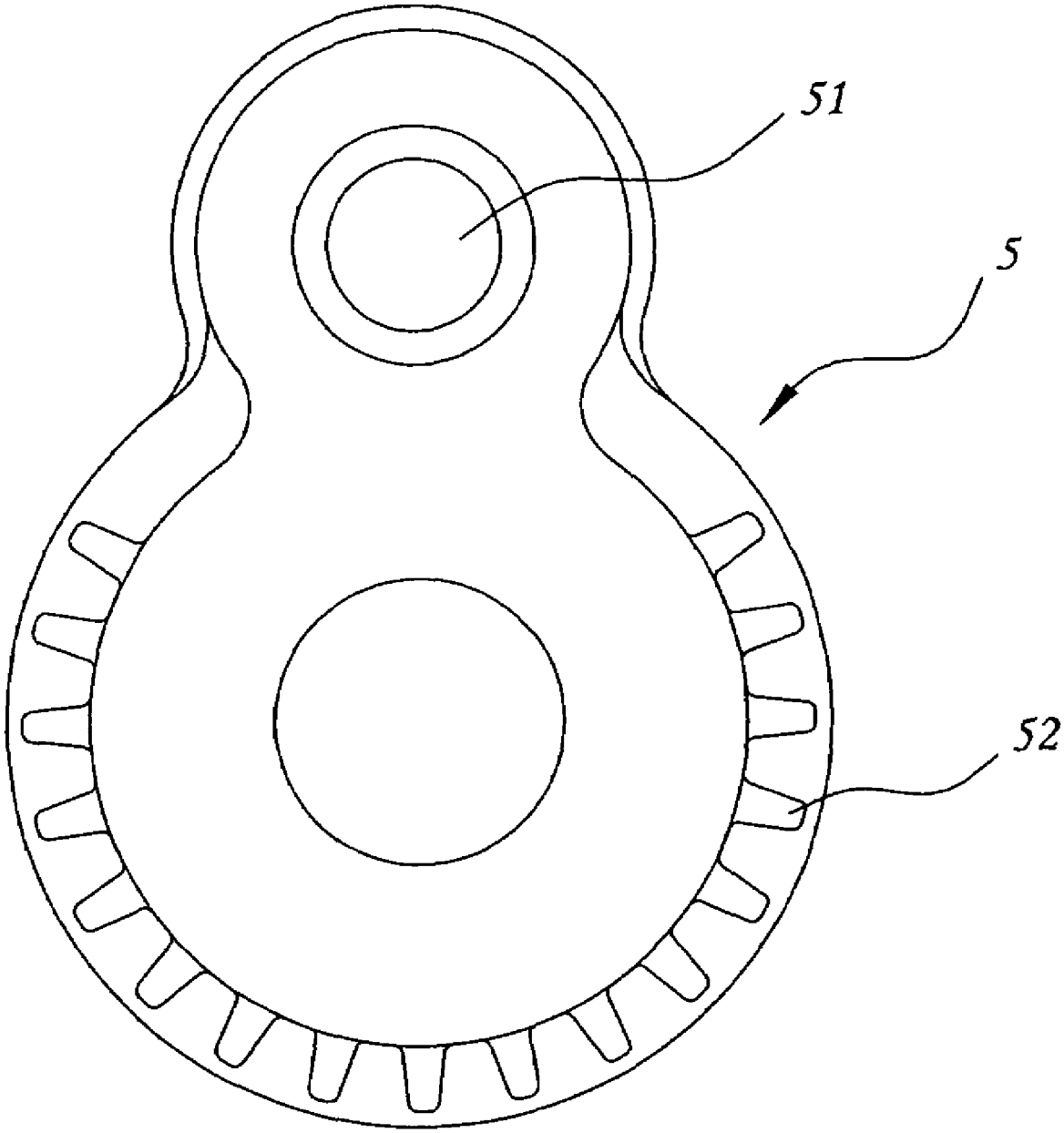
FIG. 3 is a plain view of the side cover for the angle-adjustable engine starting structure according to the present invention.

The side cover 5 has an inside space (not shown) that accommodates the drive gear 41 and the driven gear 3, a through hole 51 cut through the front and back sides for the passing of the starter barrel 4, a forwardly extending shaft 53, and a plurality of radial teeth 52 equiangularly spaced around the shaft 53 (see FIG. 3). The radial teeth 52 have a 15° pitch angle. After mounting of the driven gear 3 and the starter barrel 4 in the side cover 5, the starter barrel 4 is inserted through the through hole 51 of the side cover 5, and the shaft of the drive gear 41 is coupled to the axle hole 21 on the partition board 2.

Figure 4:
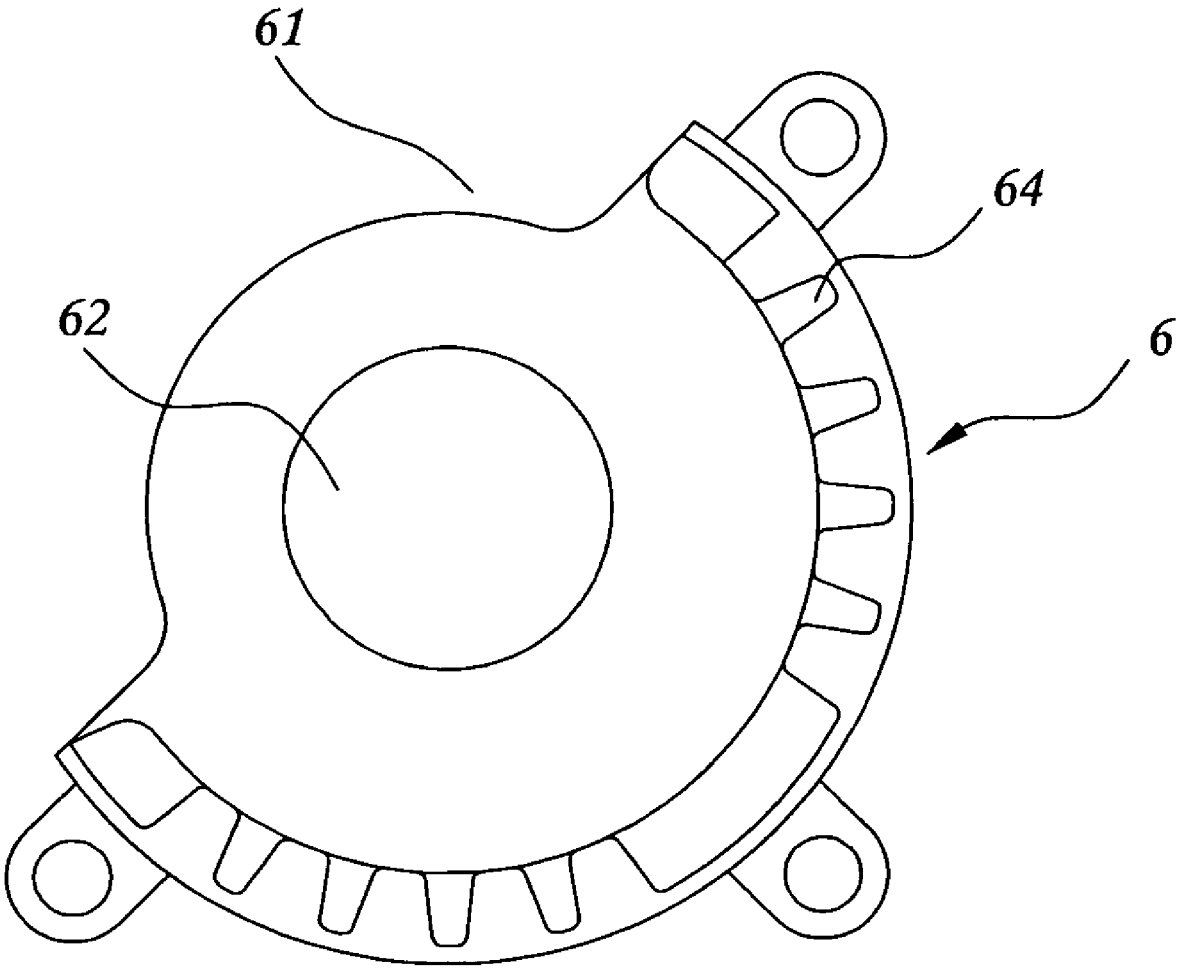
FIG. 4 is a plain view of the outer cover for the angle-adjustable engine starting structure according to the present invention.

The outer cover 6 has a back space that accommodates the side cover 5, a 180° side opening 61, which receives a part of the starter barrel 4 that extends out of the through hole 51 of the side cover 5, a center hole 62, a plurality of radial teeth 64 protruding from the inside wall and equiangularly spaced around the center hole 62 (see FIG. 4), and a plurality of mounting through holes 63. The radial teeth 64 have a 15° pitch angle. The mounting through holes 63 of the outer cover 6 are respectively fastened to respective screw holes 12 on the engine 1 with respective screws 65, keeping the radial teeth 64 of the outer cover 6 meshed with the radial teeth 52 of the side cover 5.

After installation of the outer cover 6 in the engine 1, the radial teeth 64 of the outer cover 6 meshed with the radial teeth 52 of the side cover 5 to prevent rotation of the starter barrel 4. When wishing to adjust the angular position of the starter barrel 4, loosen the screws 65 from the respective screw holes 12, and then pull the outer cover 6 outwards to disengage the radial teeth 64 of the outer cover 6 from the radial teeth 52 of the side cover 5, and then turn the side cover 5 to change the position of the starter barrel 4 in the side opening 61 to the desired angle relative to the outer cover 6. When wishing to change the angular position of the starter barrel 4 through a big angle, remove the screws 65 from the engine 1 and the outer cover 6, and then turn the outer cover 6 to the desired angle, and then install the screws 65 to affix the outer cover 6 to the engine 1 in the adjusted position.

Figure 5:
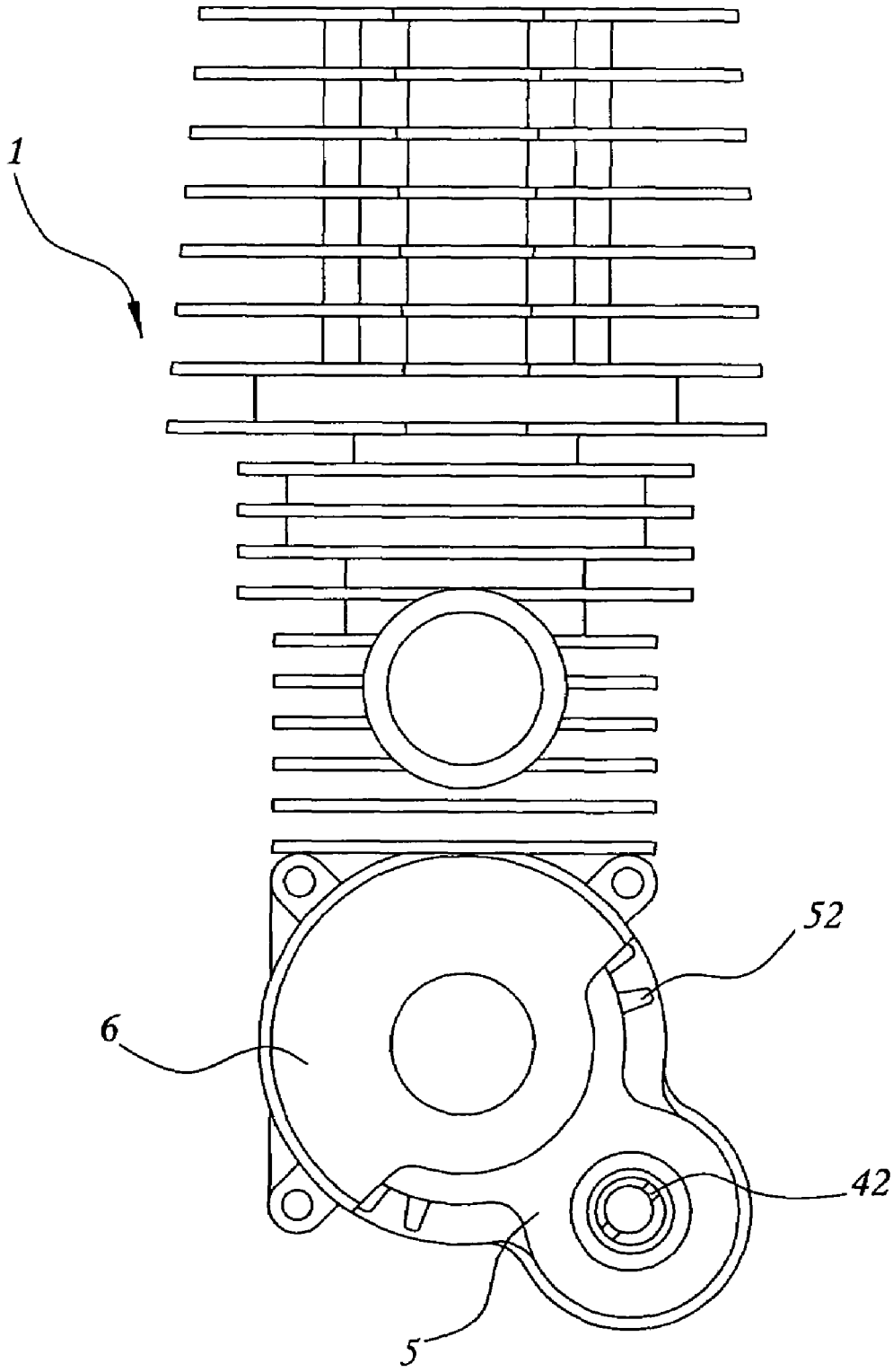
FIG. 5 is a schematic plain view of the present invention, showing the relative positioning between the side cover and the outer cover.
Figure 6:
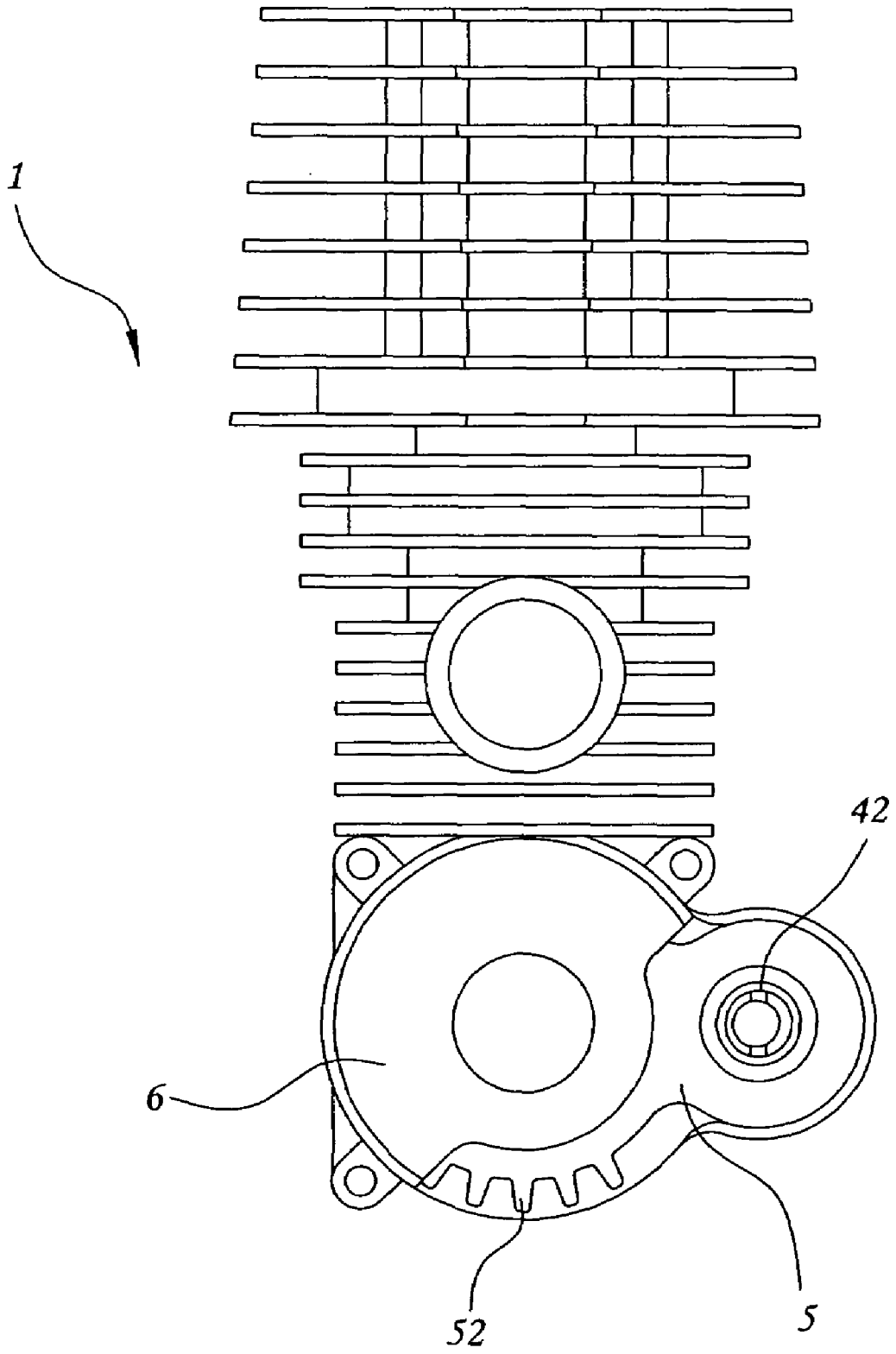
FIG. 6 corresponds to FIG. 5, showing the angular position of the side cover adjusted relative to the outer cover.
Figure 7:
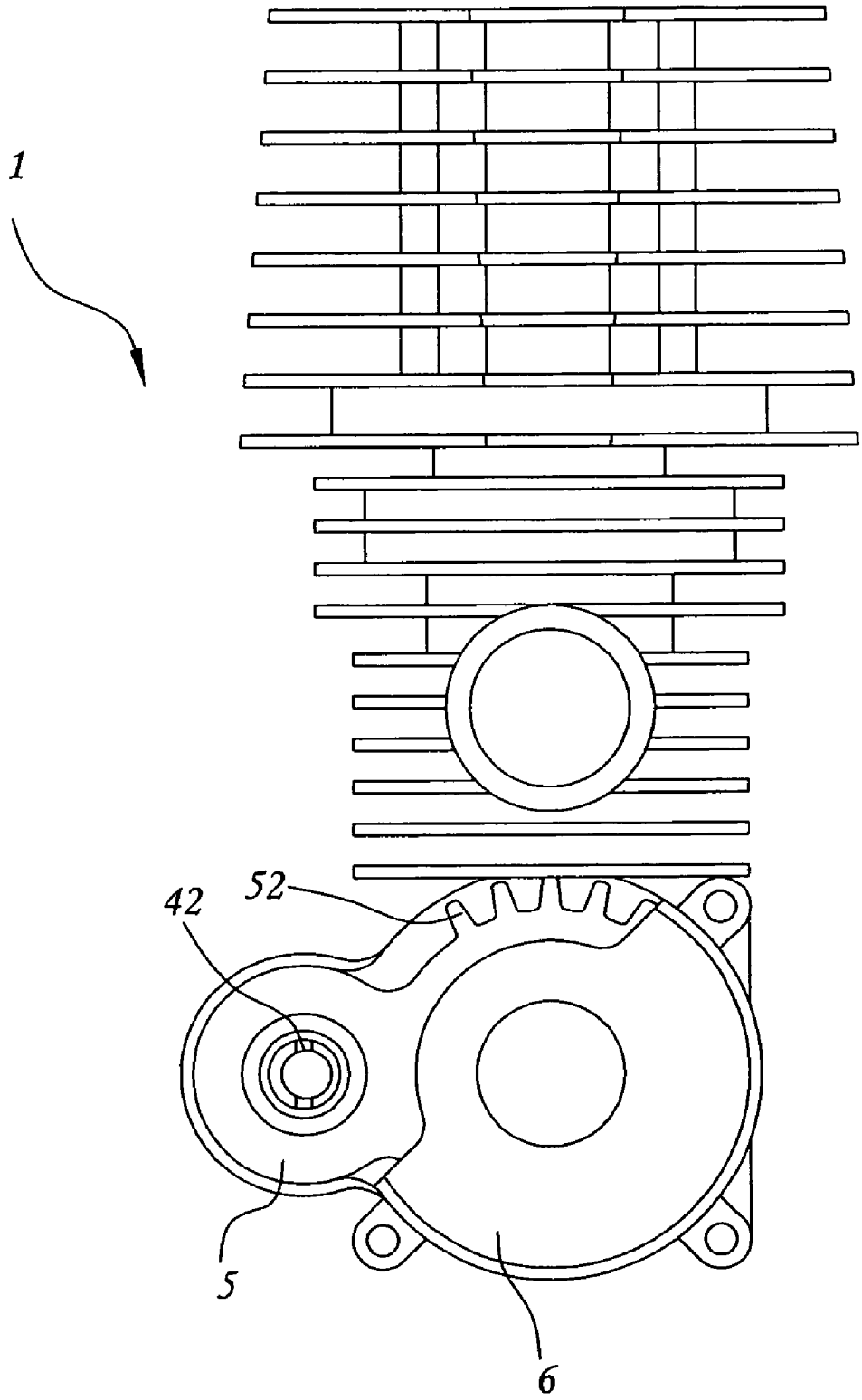
FIG. 7 is a schematic plain view of an alternate form of the present invention, showing the relative positioning between the side cover and the outer cover.
Figure 8:
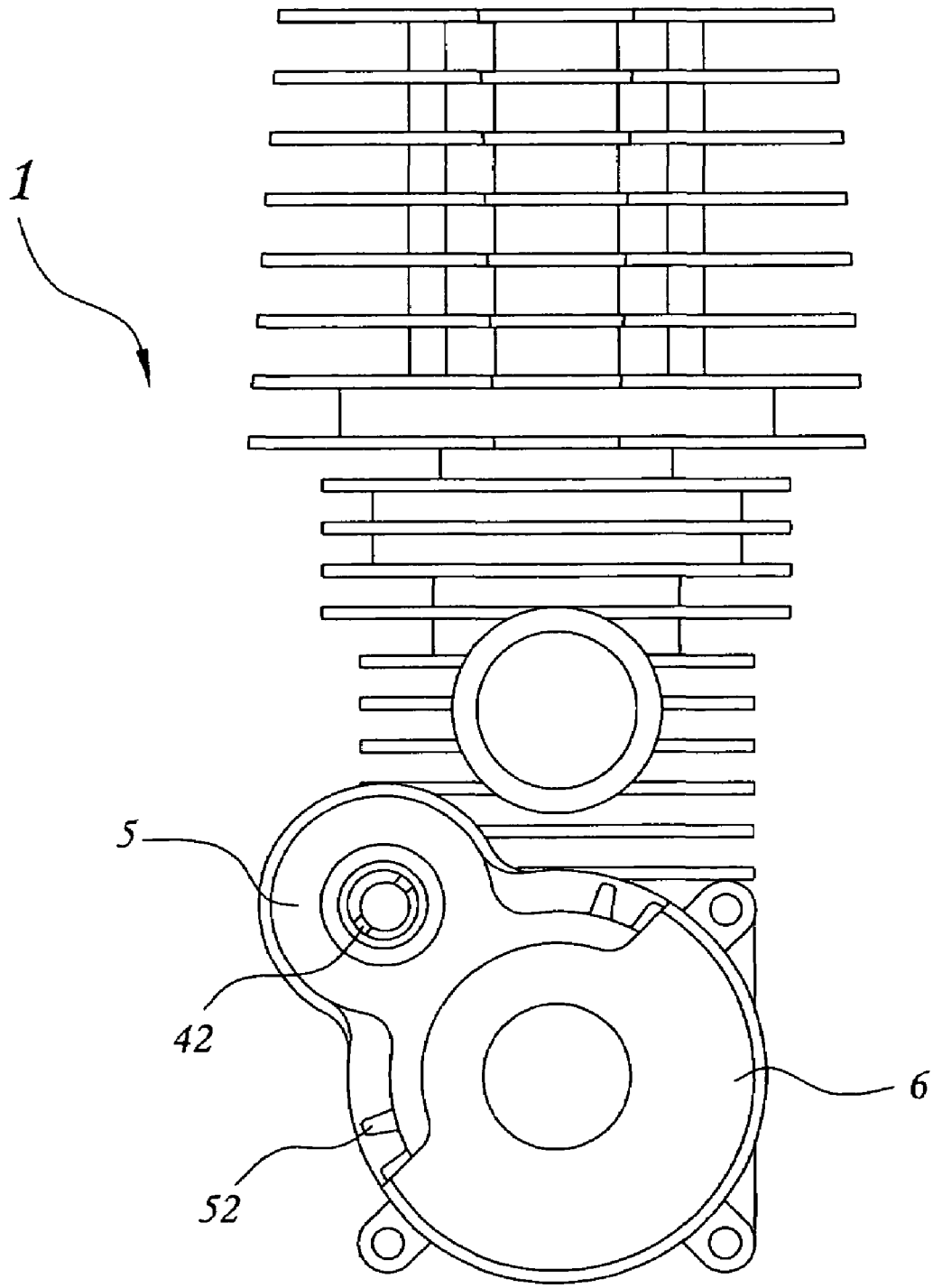
FIG. 8 corresponds to FIG. 7, showing the angular position of the side cover adjusted relative to the outer cover.

FIGS. 5 and 6 show the 180° side opening 61 provided at the lower right corner of the outer cover 6, allowing adjustment of the angular position of the through hole 51 of the side cover 5 and the starter barrel 4 in the lower right corner of the outer cover 6 within 180°. FIGS. 7 and 8 show the 180° side opening 61 provided at the upper left corner of the outer cover 6, allowing adjustment of the angular position of the through hole 51 of the side cover 5 and the starter barrel 4 in the upper left corner of the outer cover 6 within 180°.

A prototype of angle-adjustable engine starter structure of an engine has been constructed with the features of FIGS. 2~9. The angle-adjustable engine starting structure of an engine functions smoothly to provide all of the features discussed earlier.

Although particular embodiments of the present invention have been described in detail for purposes of illustration, various modifications and enhancements may be made without departing from the spirit and scope of the invention. Accordingly, the invention is not to be limited except as by the appended claims.

What is claimed is:

1. An angle-adjustable engine starting structure comprising:

an engine, said engine having an one-way axle bearing fixedly mounted on an output shaft thereof;

a partition board fastened to said engine around said one-way axle bearing, said partition board having an axle hole;

a driven gear coupled to said one-way axle bearing for synchronous rotation with said one-way axle bearing and the output shaft of said engine;

a starter barrel for driving by an electric starter to rotate said driven gear, said starter barrel having a drive gear fixedly provided at an end thereof and pivotally coupled to the axle hole of said partition board and meshed with said driven gear;

a side cover covering said driven gear and said starter barrel, said side cover having a through hole for the passing of said starter barrel, a forwardly extending shaft, and a plurality of radial teeth equiangularly spaced around the forwardly extending shaft of said side cover; and an outer cover affixed to said engine and covering said side cover, said outer cover having a back space that accommodates said side cover, a side opening; which receives a part of said starter barrel that extends out of the through hole of said side cover, a center hole coupled to the forwardly extending shaft of said side cover, a plurality of radial teeth protruding from an inside wall thereof and equiangularly spaced around the center hole and meshed with the radial teeth of said side cover, and a plurality of mounting through holes fastened to said engine with respective screws.

2. The angle-adjustable engine starting structure as claimed in claim 1, wherein the radial teeth of said outer cover and the radial teeth of said side cover have a 15° pitch angle.

3. The angle-adjustable engine starting structure as claimed in claim 1, wherein the side opening of said outer cover extends through 180°.

* * * * *